United States Patent [19]

Schwinn

[11] 4,055,305

[45] Oct. 25, 1977

[54] NON-CLOG WATER DISTRIBUTION NOZZLE

[75] Inventor: Joseph Michael Schwinn, Healdsburg, Calif.

[73] Assignee: Ecodyne Corporation, Lincolnshire, Ill.

[21] Appl. No.: 683,586

[22] Filed: May 5, 1976

[51] Int. Cl.[2] ..... B05B 1/26

[52] U.S. Cl. ..... 239/524; 261/111

[58] Field of Search ..... 239/518, 521, 522, 524; 169/37; 85/80, 5 R; 261/98, 111, DIG. 11

[56] References Cited

U.S. PATENT DOCUMENTS

| | | | |
|---|---|---|---|
| 716,635 | 12/1902 | Haycraft | 239/518 |
| 1,978,721 | 10/1934 | Perkins | 239/521 X |
| 3,061,204 | 10/1962 | MacInnes et al. | 239/522 X |
| 3,213,746 | 10/1965 | Dwyer | 85/80 |
| 3,303,717 | 2/1967 | Valenti | 85/80 X |
| 3,717,066 | 2/1973 | Maurer | 85/5 R |

*Primary Examiner*—John J. Love
*Assistant Examiner*—Michael Mar
*Attorney, Agent, or Firm*—Joel E. Siegel; Charles M. Kaplan

[57] ABSTRACT

The liquid deflecting surface of a conical baffle of a spray nozzle is defined by an arc of a circle rotated around the central axis of the nozzle, and a single supporting arm for the baffle has a knife-like edge that merges into the point of such conical surface.

10 Claims, 7 Drawing Figures

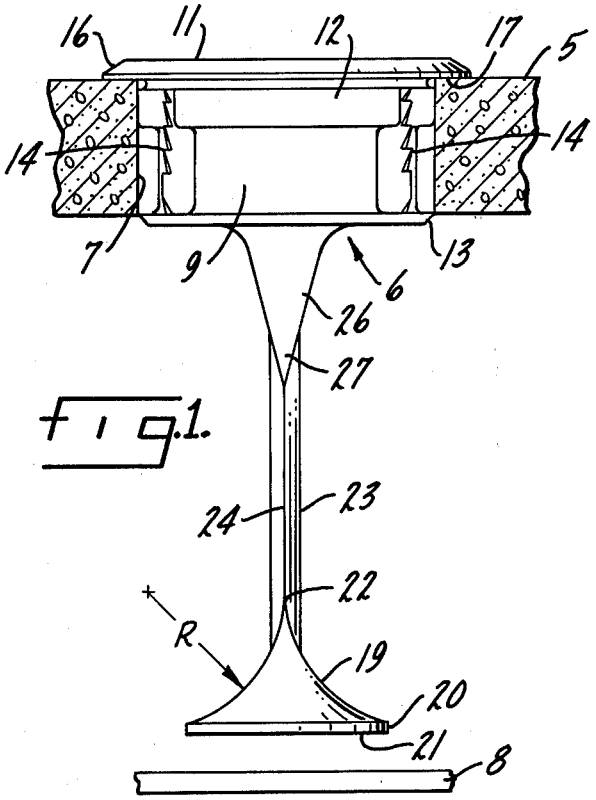
fig.1.
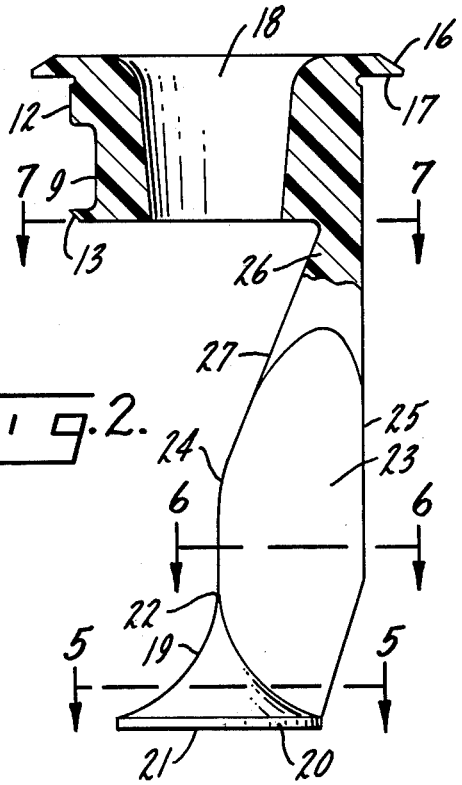
fig.2.
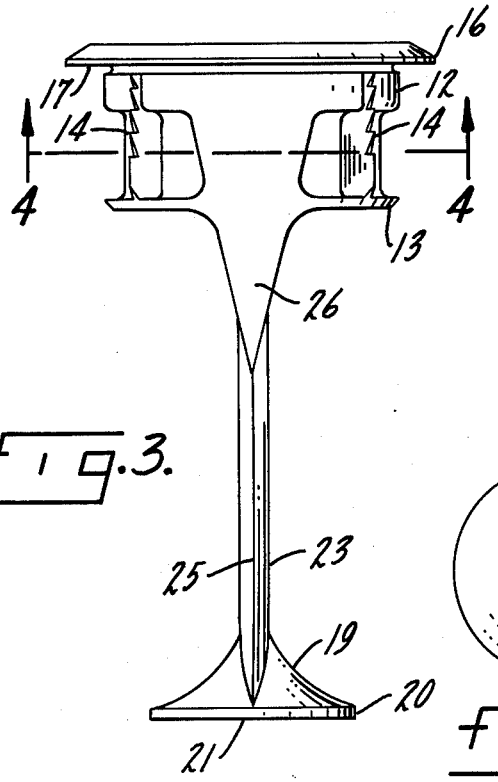
fig.3.
fig.4.
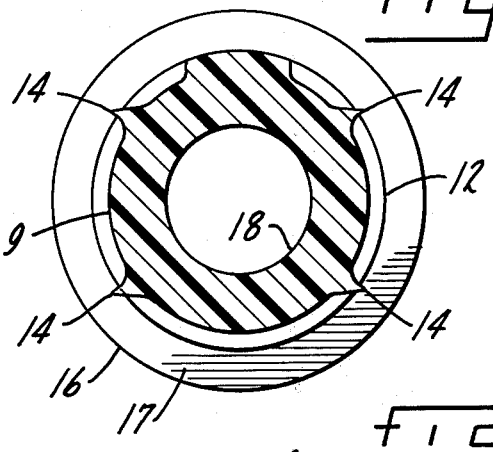
fig.7.
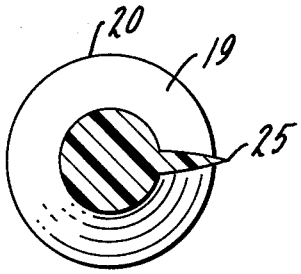
fig.5.
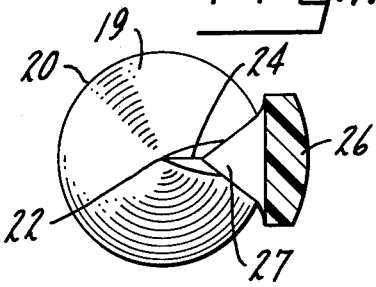
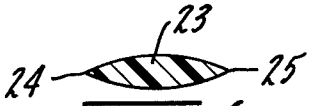
fig.6.

NON-CLOG WATER DISTRIBUTION NOZZLE

BACKGROUND OF THE INVENTION

This invention relates to nozzles, and more particularly to spray nozzles for distributing hot liquid over the fill in a cooling tower.

In some cooling towers liquid to be cooled is pumped up to an open-topped hot water distribution basin extending over most of the upper surface of the tower. Solid objects which fall on the tower collect in such a basin and pass with the liquid being cooled into the nozzles which spray the liquid over the cooling tower fill. To ensure efficient use of all of the fill in a cooling tower, the liquid being cooled should be evenly distributed over the fill. Even distribution of the liquid can be economically achieved by using baffle-type nozzles to spray the hot liquid in essentially circular patterns on to the top of the fill. However, prior art spray nozzles have not been satisfactory because the structure supporting the spray creating baffles, and the baffles themselves, often become clogged by solid objects in the liquid being cooled. Such clogging disrupts the circular spray patterns and thus prevents even distribution of liquid over the fill.

Accordingly, it is an object of this invention to provide an improved liquid spray nozzle.

Another object is to provide a clog-free nozzle for spraying hot liquid over the fill in a cooling tower.

Another object is to provide a clog-free nozzle that sprays liquid into a circular pattern.

Another object is to provide a nozzle that creates a circular spray pattern in an unpressurized system by using a single baffle supported by a single arm.

Another object is to provide an improved nozzle for spraying liquid that flows through the nozzle solely under the influence of gravity.

Another object is to provide a spray nozzle that is durable, relatively lightweight, corrosion-resistant, and inexpensive.

Still other objects and advantages of the invention will be revealed in the specification and claims, and the scope of the invention will be set forth in the claims.

DESCRIPTION OF THE DRAWINGS

FIG. 1 is a partially broken-away, schematic, front view of a preferred embodiment of the invention.

FIG. 2 is a partial cross sectional side view of the invention.

FIG. 3 is a rear view of the invention.

FIG. 4 is a sectional view taken along the line 4—4 in FIG. 3.

FIG. 5 is a sectional view taken along the line 5—5 in FIG. 2.

FIG. 6 is a sectional view taken along the line 6—6 in FIG. 2.

FIG. 7 is a sectional view taken along the line 7—7 in FIG. 2.

DESCRIPTION OF A PREFERRED EMBODIMENT

The drawing shows a portion of a concrete liquid cooling tower of the general type disclosed in U.S. Pat. No. 3,830,476, which is assigned to the same assignee as this invention. Water to be cooled collects in a concrete hot water distribution basin 5, and flows into a plurality of spray nozzles 6 which pass through holes 7 in basin 5.

The hot water is sprayed evenly by each nozzle 6 in a circular pattern over any suitable type cooling tower packing or fill 8.

Nozzle 6 is molded as a unitary object from plastics or metals. Nozzle 6 has an enlarged tubular member 9 at its upper end 11. A relatively thick bead 12 extends around the outside of member 9 adjacent end 11, and a relatively thin bead 13 extends around the outside of member 9 and defines its lower end. Beads 12 and 13 have the same outer diameter, which is also the same as the diameter of hole 7; thus beads 12 and 13 locate nozzle 6 in the center of hole 7 with the central axis of nozzle 6 coinciding with the central axis of hole 7. Several rows of upwardly projecting teeth 14 are spaced around member 9, with teeth 14 projecting slightly beyond beads 12 and 13. When nozzle 6 is forced into hole 7, teeth 14 are compressed or deformed inwardly and thus hold nozzle 6 securely in place. Nozzle 6 resists being pulled up or shaken by vibration out of hole 7 because teeth 14 tend to expand or bite into basin 5 when nozzle 6 is moved upwardly. A peripheral rim 16 projects beyond bead 12, and its underside 17 fits against basin 5 around hole 7. Rim 16 and bead 12 provide sealing surfaces that prevent liquid from flowing through hole 7 around the outside of nozzle 6.

A tapered circular hole 18 passes through the center of member 9 and directs a column of liquid against the spray creating outer curved surface 19 of a single conical baffle 20. The liquid falls through nozzle 6 under the influence of gravity alone in this non-pressurized system. Surface 19 is defined by rotation of a circular arc around an axis passing through the center of hole 18, thus centering baffle 20 on the central axis of nozzle 6 directly below hole 18. It has been determined empirically by experimentation and analysis that the length of the radius R of the circular arc which defines surface 19 should be equal to two-thirds of the diameter of the base 21 or baffle 20. The upper end of baffle 20 terminates at a sharp point 22.

Baffle 20 is connected to member 9 by a single integral supporting arm 23 which is relatively thin in relation to its length and width. Arm 23 tapers quickly to a pair of knife-like terminal edges 24 and 25, with edge 24 merging directly into point 22. Edge 24 also extends directly upwardly from point 22 for a substantial distance along the central axis of nozzle 6. The upper portion 26 of arm 23 tapers outwardly where it merges into member 9 in order to strengthen arm 23. The sharp surface of front edge 24 causes minimum disruption of the column of liquid being directed against surface 19 because it cuts into such column with essentially no turbulence or splashing; some liquid clings to the relatively broad but thin sides of arm 23 by essentially non-turbulent laminar flow and is this directed against surface 19 almost as if it had fallen directly from hole 18. Any liquid that happens to contact rear edge 25 or the pointed lower end 27 of portion 26 behaves in essentially the same manner as described above.

Nozzles 6 essentially identical to those shown in the drawing have been used to spray hot water from a plant that generates electricity on to the fill in a concrete cooling tower. The hot water had a temperature of about 120° F, and passed through the nozzles under the influence of gravity alone. Such nozzles were molded from high molecular polypropylene. The small diameter lower end of hole 18 was 0.875 inches and the hole tapered upwardly and outwardly at an angle of 5°. The diameter of baffle 20 at its base 21 was 1.375 inches, and edge 24 extended directly upwardly from point 22 along the central axis of the nozzle for one half inch. The radius R of surface 19 was 0.917 inches, which is two-thirds of the diameter of the base 21 of baffle 20, and point 22 was located 2.37 inches below the lowermost surface of member 9. Each of these nozzles sprayed the hot water outwardly and downwardly into a circular pattern, and because the nozzles were symetrically placed in hot water distribution basin 5, the hot water was uniformly distributed over the fill 8 in the cooling tower. Numerous solid objects collected in the open-topped basin, but all such objects that passed through openings 18 were either deflected out of the way by arms 23 or else they passed over baffles 20 without causing permanent disruption of the circular spray patterns. In no case did such solid objects clog any nozzles.

It has thus been shown that by the practice of this invention a rugged, low-cost nozzles uses a single baffle to create a circular spray pattern in a non-pressurized system. Clogging of this nozzle by solid objects in the liquid being sprayed is prevented by the use of a single baffle-supporting arm having a sharp knife-like edge that blends directly into the point of the curved conical surface of the baffle.

While the present invention has been described with reference to a particular embodiment, it is not intended to illustrate or describe herein all of the equivalent forms or ramifications thereof. Also, the words used are words of description rather than limitation, and various changes may be made without departing from the spirit and scope of the invention disclosed herein. It is intended that the appended claims cover all such changes as fall within the true spirit and scope of the invention.

What is claimed is:

1. A gravity liquid spray nozzle comprising at its upper end a tubular member for placement in a liquid discharge opening, a hole through said tubular member for directing non-pressurized liquid into a downwardly flowing stream, a single conical baffle that creates a circular spray pattern, said baffle having a sharp point at its upper end spaced below the center of said hole, the spray creating surface of said conical baffle being defined by an arc of a circle rotated about an axis passing through said center of said hole, and a baffle supporting arm extending downwardly from said tubular member and being connected to said conical surface, said arm tapering to a knife-like terminal edge which merges into said sharp point of said conical surface, said edge extending upwardly from said point at the central axis of said nozzle in said stream of liquid flowing downwardly under the influence of gravity.

2. The invention defined in claim 1 wherein means for anchoring said nozzle in a liquid discharge opening comprises upwardly projecting rows of teeth on the exterior surface of said tubular member.

3. The invention defined in claim 1 wherein a peripheral rim projecting from the upper edge of said tubular member extends beyond such liquid discharge opening.

4. The invention defined in claim 1 wherein a pair of spaced beads extend around the outside of said tubular member for locating said nozzle in the center of said liquid discharge opening.

5. The invention defined in claim 4 wherein the uppermost of said pair of beads is thicker than the lowermost bead.

6. The invention defined in claim 1 wherein said edge extends directly upwardly from said point for a substantial distance along the central axis of said nozzle.

7. The invention defined in claim 1 wherein the radius of said rotated circle is equal to two-thirds of the diameter of the base of said conical baffle.

8. The invention defined in claim 1 wherein said hole is circular and tapers toward its lower end.

9. The invention defined in claim 1 wherein said arm is relatively thin in comparison with its length and width and both of its edges taper quickly to knife-like surfaces.

10. An integral, molded, plastic liquid spray nozzle comprising at its upper end a tubular member having rows of upwardly projecting teeth on its exterior surface for anchoring said nozzle in a liquid discharge opening, a peripheral rim projecting from said tubular member extending beyond such liquid discharge opening, a tapered circular hole through said tubular member directing such liquid into a downwardly flowing stream, a pair of vertically spaced beads extending around the outside of said tubular member and the uppermost of said beads being thicker than the lowermost, a single conical baffle that creates a circular spray pattern, said baffle having a sharp point at its upper end spaced below said circular hole, the spray creating surface of said conical baffle being defined by an arc of a circle rotated about an axis passing through the center of said circular hole, the radius of said rotated circle being equal to two-thirds of the diameter of the base of said conical baffle, and a single baffle supporting arm extending from said tubular member and connected to said conical surface, said supporting arm being relatively thin in comparison with its length and width and tapering quickly to a pair of knife-like terminal edges, and one of said knife-like edges merging into said sharp point of said conical surface and extending directly upwardly from said point along the central axis of said nozzle so as to project into said downwardly flowing liquid stream.

* * * * *